United States Patent [19]

Ptaszek et al.

[11] 4,327,911

[45] May 4, 1982

[54] GAME APPARATUS UTILIZING A SIGNALLING MEANS

[76] Inventors: George W. Ptaszek, P.O. Box 260, Pascoag, R.I. 02859; Robert B. Romine, Box 235, Rte. 1, Lonoke, Ark. 72086

[21] Appl. No.: 175,332

[22] Filed: Aug. 4, 1980

[51] Int. Cl.[3] ..... A63F 9/00

[52] U.S. Cl. ..... 273/1 GE; 273/1 GG; 273/DIG. 26

[58] Field of Search ..... 273/1 GE, 1 R; 1 GG, 273/1 G, 86 A, 86 R, 145 A, 146, 272, DIG. 26, 286

[56] References Cited

U.S. PATENT DOCUMENTS

| | | | |
|---|---|---|---|
| 2,739,815 | 3/1956 | Fay | 273/146 X |
| 3,414,264 | 12/1968 | Schriber | 273/86 A X |
| 3,437,337 | 4/1969 | Larson | 273/1 GE |
| 3,614,105 | 10/1971 | Dandini | 273/146 |
| 4,158,342 | 6/1979 | Scruggs | 273/DIG. 26 X |

FOREIGN PATENT DOCUMENTS

| | | | |
|---|---|---|---|
| 879033 | 11/1942 | France | 273/1 GE |

OTHER PUBLICATIONS

Playthings Magazine, vol. 56, Issue No. 9, 9-1958, p. 103, Spill & Spell.

*Primary Examiner*—Paul E. Shapiro
*Attorney, Agent, or Firm*—Barlow & Barlow

[57] ABSTRACT

The present invention comprises a game apparatus utilizing a plurality of multi-colored signalling, indicating cubes. A combination random shaking device and game storage container is used to obtain a random array of the plurality of multi-colored signalling indicator cubes on a playing surface. A plurality of correspondingly colored playing chips is randomly displayed on the playing surface. As the multi-colored signalling indicators are randomly dispersed into an array on the playing surface if a predetermined plurality of color combination occurs, the players attempt to remove a correspondingly colored playing chip from the surface. The player not able to retrieve the chip moves his scoring device in a predetermined manner. The winning player is the one whose scoring device only partially or not at all obstructs a predetermined indicia pattern.

10 Claims, 5 Drawing Figures

GAME APPARATUS UTILIZING A SIGNALLING MEANS

BACKGROUND OF THE INVENTION

The subject invention relates to a signalling game apparatus.

The present invention also relates to a game apparatus utilizing both a plurality of multi-colored signalling cubes, and a plurality of correspondingly colored chips. In the prior art the only use known of colored cubes is shown in U.S. Pat. No. 3,204,956 that deals with visual recognition.

The present invention also relates to a contest-type game of skill requiring quick physical responses by the participants to a visual recognition of a varying set of color signals produced through chance.

The present invention more particularly relates to a game apparatus for developing abilities of visual recognition and swift physical reactions in an entertaining and challenging way for two or more contestants. This is achieved by combining a contest involving manual action, a visual recognition, and physical reaction on the part of the participants.

The game apparatus is simply designed and the apparatus is foolproof, so that no player will have an undue advantage, other than those provided by his natural abilities of visual perception and rapid physical reactions to visual stimuli.

SUMMARY OF THE INVENTION

It is, therefore, an object of the present invention to provide a game apparatus utilizing both a plurality of multi-colored signalling cubes and a plurality of correspondingly colored playing chips.

It is accordingly another object of the present invention to provide a contest type game of skill requiring quick physical responses by the participants to a visual recognition of a varying set of color signals produced through chance.

It is a further object of the present invention to provide a game apparatus having the above objects and that is easy both to manufacture and assemble, being of low cost to the consumer, and relatively easy to understand and participate in properly.

In the embodiment shown herein, the random signalling means consists of a plurality of playing cubes, each having a differently colored indicating surface painted on each of the six sides. A combination shaking device and game storage container is employed in order to obtain a randomly determined array of colored cube indicating surfaces during each of the players' turn. A plurality of playing chips having color indicating surfaces which correspond to the colored indicating surfaces of playing cubes, are also randomly arrayed on the playing surface and within the grasp of the players. As the signalling indicator cubes are shaken and then randomly spilled onto a playing surface, if a predetermined numerical plurality of similarly colored surfaces are displayed during the discrete turn, the various players attempt to remove one of the similarly colored player chips from the surface. Each indicator color surface is represented by a number of correspondingly colored chips, being one less than the number of contestants. Therefore, the player not able to retrieve the properly colored chip during his turn will then uncover a letter or other indicia on his individual player scoring device.

The next playing turn then proceeds in a sequential fashion. The player who has been unable to retrieve a sufficient number of chips thereby will uncover in the process all the indicia or letters on his player scoring device, thereby displaying, for example, the words "L-E-F-T-O-U-T", and is thereby removed from the play of the game. The play turn then proceeds, after first removing the necessary number of playing chips, until only one winning player remains, that being the one having several letters of the scoring device still covered.

In the embodiment of the above game as described, there is also utilized a plurality of cube surfaces that are marked "WILD" instead of painted discrete colors. These surfaces may match any color desired by the participants of the contest.

Other objects, advantages, and meritorious features will be more fully apparent from the following specifications, claims and accompanying drawings.

BRIEF DESCRIPTION OF THE DRAWINGS

The preferred embodiment and best mode contemplated for practicing the just described invention will now be described in detail in conjunction with the drawings, of which.

DESCRIPTION OF THE PREFERRED EMBODIMENT

Figure 1:
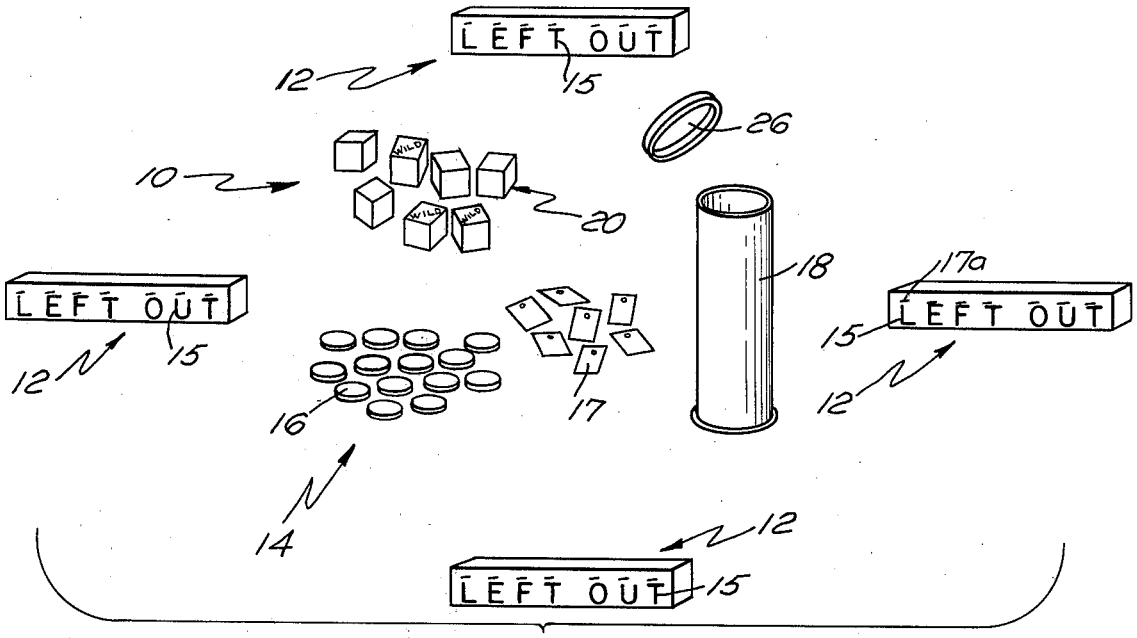
FIG. 1 is a perspective view of the game apparatus of the present invention.

Referring to FIG. 1, the game apparatus random signalling means array is designated generally as 10. The game player scoring device of the present invention is generally designated as 12. The game apparatus colored playing chip array is indicated generally as 14, with the individual colored playing chips being shown as 16. There are three playing chips of each discrete color and there are six discrete different colors represented. Thus, in the example illustrated, there are a sum total of eighteen playing chips 16, included within the game apparatus of the present invention. The unified shaking and storage means device for the signalling means array 10 is designated as 18. The individual playing cube signalling component is further represented as 20.

Figure 3:
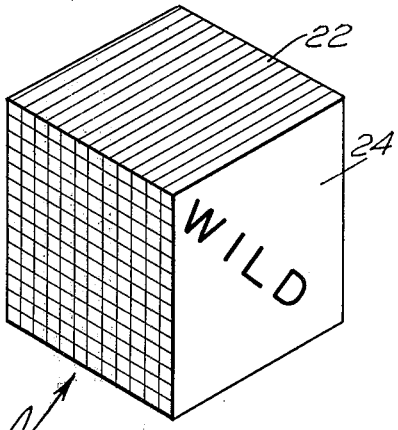
FIG. 3 is an enlarged perspective view of a representative playing cube signalling component of the present invention.

As seen in FIG. 3, the playing cube signalling means component 20 is shaped in a six-sided cube configuration. On each cube five of the six indicating surfaces 22 will have a distinctive solid color with one indicating surface 24 of three cubes having the word "WILD" printed thereon.

The signalling means array 10 consists of a plurality (seven in the present embodiment) of individual playing cube components 20. The topmost indicating surfaces 22 are the signalling surfaces that are considered when viewing a random array 10 during the course of the play.

The plurality of individual signalling playing cubes 20 are gathered together and then placed within the cylindrically shaped cube shaking device 18 by the player having the turn. The cover 26 is then placed on the open end of the cube shaking device 18, and signalling curves 20 are randomly distributed by shaking several times, prior to removing the cover 26, and then depositing the cubes 20 upon the playing surface thereby forming a random array 10.

Figure 2A:
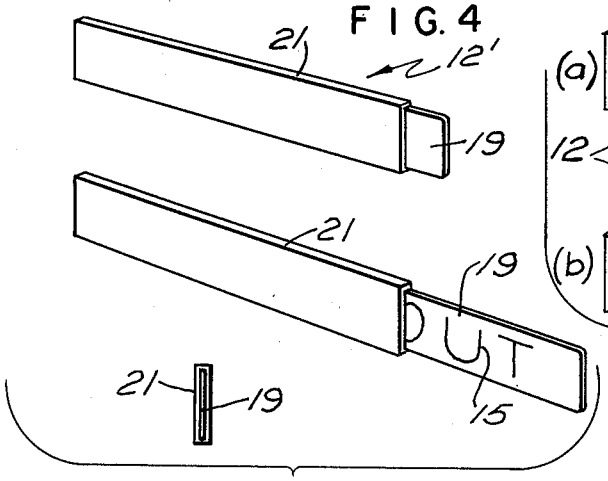
FIG. 2A is a perspective view of another form of player scoring device.
Figure 2:
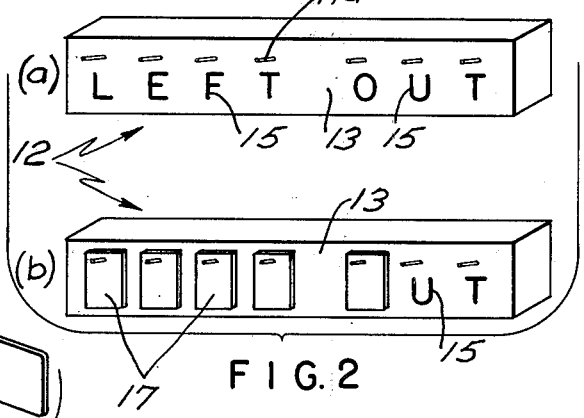
FIG. 2 is a perspective view of the player scoring device.

In FIG. 2 there is shown in the upper representation (a) in FIG. 2 one embodiment of the player scoring device 12. The letter indicating face is designated as 13. The individual letters spelling "L-E-F-T-O-U-T" are each depicted as 15. The lower representation (b) depicts several letters 15 being visible, whereas the other letters 15 are still covered by letter covering blanks 17 hung on pegs 17*a*.

An alternate embodiment is shown in FIG. 2A. In this format the letters 15 are sequentially uncovered starting with the last letter first during play by moving a sliding letter bar 19, guided by letter bar guide 21 to the desired position.

Describing the course of playing the game, initially the various individual player scoring devices 12 are arranged so that the appropriate letter indicating face 13 is opposite each player's seating position. Located within the playing space defined by the plurality of player scoring devices 12 is the general play area. The plurality of individual playing chips 16 is randomly distributed as a playing chip array 14. This playing chip array 14 is conveniently located within the sight and reach of all the players of the game. The rest of the playing area is to be utilized for the formation and display of a random signalling means array 10, formed from the plurality of displayed individual playing signalling cube components 20.

Initially, all of the letters 15, printed on the individual player scoring devices 12, are covered either by means of the letter covering blanks 17, or the sliding letter bar 19, according to the preferred embodiment. Each player in turn will gather the plurality of individual signalling playing cubes 20 together and place them into the cube shaking device 18. They are then thoroughly and randomly mixed prior to their release onto the playing area, thereby creating the random signalling means array 10.

When four indicating surfaces 22 of the same discrete color are randomly displayed, the players must immediately attempt to pick up the matching correspondingly colored playing chip that is randomly arranged on the playing area. The player who is not able to pick up a chip of the designated color is considered "L-E-F-T-O-U-T", and must immediately expose the last uncovered letter 15 on his player scoring device 12.

The play continues in sequential player turns as above until all the indicia or letters 15 "L-E-F-T-O-U-T" are fully exposed on a player's scoring device 12. This player is now out of the game.

At this time, one complete set of six colored chips are removed from the playing area, so that each plurality of colored chips contains one less than the total number of players remaining in the game, and play continues as discussed above until only one player remains having at least one indicia or leter 15 still uncovered. This player is the winner of the game.

As mentioned previously, a plurality of the signalling surfaces 24 on selected player cubes 20 are marked with the letters "WILD", instead of having a colored surface. These "WILD" surfaces 24 during the course of play can be utilized by the players to match any desired combination of displayed colored indicating surfaces 22. Therefore, during play a random array of signalling cubes containing from one to three "WILD" signalling surfaces, and having also the needed colored signalling surfaces 22 to complete the four same colored surfaces is a valid signalling combination as discussed above.

Figure 4:
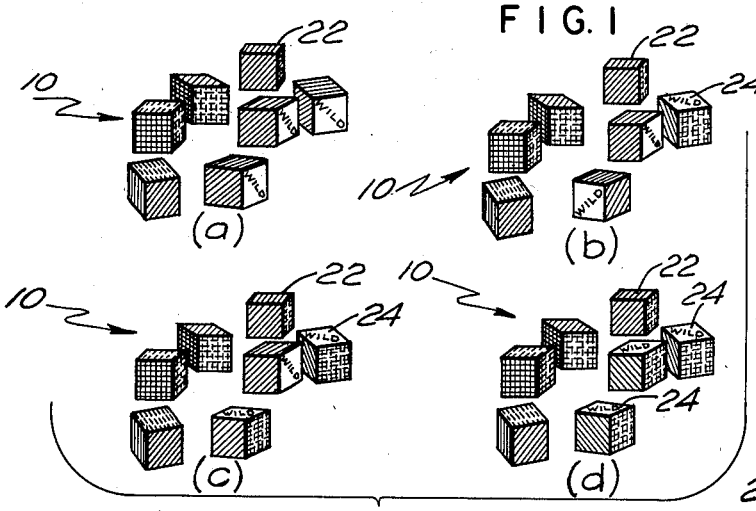
FIG. 4 is a perspective view of several random sample arrays of the signalling cubes.

FIG. 4 is a top and side view of several random sample arrays of the signalling cubes utilizing "WILD" indicating sides. Component (a) shows a combination match of four or more same color indicating surfaces. Component (b) depicts a combination match formed from the use of one "WILD" indicating surface and three same color indicating surfaces. Component (c) depicts a combination match formed from the use of two "WILD" indicating surfaces, and two same color indicating surfaces. Component (d) further depicts a combination match formed from the use of three "WILD" indicating surfaces and one color indicating surface. It should be noted at this time that all plays involving "WILD" indicating surfaces are determined by the color of the playing chip first pulled out from the playing chip array. It should further be noted that during the course of play if a player should merely touch a playing chip of the incorrect color, he must uncover one of the letters on his scoring device.

From the above described embodiments, it is apparent that the present invention provides an interesting contest-type game of skill, requiring quick physical responses by the participants to a visual recognition of varying sets of color signals produced through chance.

While the present invention has been described in detail in connection with the preferred embodiments, it is to be understood that we do not intend to limit the invention to these embodiments. On the contrary, we intend to cover the alternatives, modifications, and equivalents as may be properly included within the spirit and scope of the invention as defined by the appended claims.

We claim:

1. A signalling game apparatus comprising in combination:

an unmarked playing surface;

a means for color signalling;

a plurality of individually moveable playing chips color coded as the colors of said signalling means distributed over and removeable from the playing surface by each player;

a means for forming a random array of said signalling means; and a plurality of player individual scoring means, one for each player, comprising a series of indicia and removable means for covering each indicia.

2. The signalling game apparatus as defined in claim 1 wherein said color signalling means comprises a plurality of multi-colored signalling indicator cubes comprising discrete colored indicating surfaces and the said color signalling means comprises a plurality of multi-colored signalling indicator cubes.

3. The signalling game apparatus as defined in claim 2 wherein the said multi-colored indicating cubes comprise differently colored indicating surfaces.

4. The signalling game apparatus as defined in claim 3 wherein the said plurality of indicating surfaces comprises in addition a plurality of said surfaces marked with a specified indicia.

5. The signalling game apparatus as defined in claim 1 wherein the said plurality of color coded playing chips comprises a series of discrete color groups.

6. The signalling game apparatus as defined in claim 5 wherein the said discrete playing chips color groups corresponds to the discrete colored indicating surfaces of said signalling indicator cubes.

7. The signalling game apparatus as defined in claim 1 wherein the said means for forming a random array of said signalling means comprises a container allowing thorough random mixing and deposition of a random array of said signalling means.

8. The signalling game apparatus as defined in claim 7 wherein the said means for forming a random array of said signalling means is also the storage means for the game apparatus of the present invention.

9. The signalling game apparatus as defined in claim 1 wherein the said player scoring means comprises a surface, and said indicia comprise letters.

10. The signalling game apparatus as defined in claim 1 wherein the specifically configured signalling arrays results in the acquisition of said color coded playing chips by the game's participants.

* * * * *